US010265766B2

(12) United States Patent
Maetani et al.

(10) Patent No.: US 10,265,766 B2
(45) Date of Patent: Apr. 23, 2019

(54) ALLOY STEEL POWDER FOR POWDER METALLURGY AND METHOD OF PRODUCING IRON-BASED SINTERED BODY

(71) Applicant: JFE STEEL CORPORATION, Tokyo (JP)

(72) Inventors: Toshio Maetani, Tokyo (JP); Shigeru Unami, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 346 days.

(21) Appl. No.: 14/787,882

(22) PCT Filed: Apr. 25, 2014

(86) PCT No.: PCT/JP2014/002343

§ 371 (c)(1),
(2) Date: Oct. 29, 2015

(87) PCT Pub. No.: WO2014/196123

PCT Pub. Date: Dec. 11, 2014

(65) Prior Publication Data

US 2016/0136727 A1 May 19, 2016

(30) Foreign Application Priority Data

Jun. 7, 2013 (JP) ..... 2013-120995

(51) Int. Cl.

| | |
|---|---|
| ***B22F 1/00*** | (2006.01) |
| ***B22F 1/02*** | (2006.01) |
| ***C21D 6/00*** | (2006.01) |
| ***C22C 38/00*** | (2006.01) |
| ***C22C 33/02*** | (2006.01) |
| ***C22C 38/16*** | (2006.01) |
| ***C22C 38/12*** | (2006.01) |
| ***B22F 3/16*** | (2006.01) |
| ***B22F 9/04*** | (2006.01) |

(52) U.S. Cl.

CPC ..... *B22F 1/0003* (2013.01); *B22F 1/0085* (2013.01); *B22F 1/025* (2013.01); *B22F 3/16* (2013.01); *B22F 9/04* (2013.01); *C21D 6/00* (2013.01); *C22C 33/0264* (2013.01); *C22C 38/00* (2013.01); *C22C 38/002* (2013.01); *C22C 38/12* (2013.01); *C22C 38/16* (2013.01); *B22F 2301/35* (2013.01); *B22F 2302/45* (2013.01)

(58) Field of Classification Search

CPC ..... B22F 1/0003; B22F 1/025; B22F 1/0085; B22F 3/16; B22F 9/04; B22F 2301/35; B22F 2302/45; C21D 6/00; C22C 38/002; C22C 33/0264; C22C 38/16; C22C 38/12; C22C 38/00; C22C 1/05; C22C 33/0207; C22C 33/0228; C22C 47/14

See application file for complete search history.

(56) References Cited

U.S. PATENT DOCUMENTS

| | | | | |
|---|---|---|---|---|
| 3,212,876 | A | 10/1965 | Hulthen et al. | |
| 5,571,305 | A | 11/1996 | Uenosono et al. | |
| 2002/0043131 | A1 | 4/2002 | Nakamura et al. | |
| 2002/0048526 | A1 | 4/2002 | Nakamura et al. | |
| 2003/0056621 | A1* | 3/2003 | Nakamura | C22C 33/0207 75/255 |
| 2005/0039576 | A1 | 2/2005 | Unami et al. | |
| 2007/0089562 | A1* | 4/2007 | Unami | C22C 33/0207 75/255 |
| 2008/0202651 | A1 | 8/2008 | Uenosono et al. | |
| 2010/0284239 | A1 | 11/2010 | Maeda et al. | |
| 2011/0103995 | A1 | 5/2011 | Klekovkin et al. | |
| 2011/0314965 | A1 | 12/2011 | Nakamura | |
| 2013/0180359 | A1 | 7/2013 | Suzuki | |

FOREIGN PATENT DOCUMENTS

| | | | |
|---|---|---|---|
| CA | 2355559 | A1 | 2/2002 |
| CN | 1109918 | A | 10/1995 |
| CN | 1344814 | A | 4/2002 |
| CN | 1598027 | A | 3/2005 |
| CN | 1908211 | A | 2/2007 |
| CN | 101844227 | A | 9/2010 |
| CN | 103143704 | A | 6/2013 |
| JP | S61-130401 | A | 6/1986 |
| JP | S63-66362 | B2 | 12/1988 |
| JP | H01127602 | A | 5/1989 |
| JP | H06-89365 | B2 | 11/1994 |

(Continued)

OTHER PUBLICATIONS

Jul. 8, 2014 International Search Report issued in International Patent Application No. PCT/JP2014/002343.
Feb. 13, 2018 Office Action Issued in U.S. Appl. No. 15/024,628.
Sep. 24, 2018 Office Action issued in U.S. Appl. No. 15/024,628.
Oct. 9, 2017 Office Action issued in Chinese Patent Application No. 201480032484.6.
Jan. 5, 2016 Office Action issued in Japanese Patent Application No. 2013-120995.
Aug. 16, 2016 Office Action issued in Japanese Patent Application No. 2013-120995.
Jun. 30, 2016 Office Action issued in Chinese Patent Application No. 201480032484.6.

*Primary Examiner* — Thorl Chea
(74) *Attorney, Agent, or Firm* — Oliff PLC

(57) ABSTRACT

Provided is an alloy steel powder for powder metallurgy containing an iron-based powder as a main component that is capable of achieving both high strength and high toughness in a sintered body using the same. In the alloy steel powder, the iron-based powder contains a reduced powder, and Mo content with respect to a total amount of the alloy steel powder is 0.2 mass % to 1.5 mass %, Cu powder content with respect to a total amount of the alloy steel powder is 0.5 mass % to 4.0 mass % and graphite powder content with respect to a total amount of the alloy steel powder is 0.1 mass % to 1.0 mass %.

3 Claims, No Drawings

(56) References Cited

FOREIGN PATENT DOCUMENTS

| | | | |
|---|---|---|---|
| JP | H07233401 | A | 9/1995 |
| JP | H07310101 | A | 11/1995 |
| JP | H08199201 | A | 8/1996 |
| JP | H08209202 | A | 8/1996 |
| JP | 2000-064001 | A | 2/2000 |
| JP | 2002-146403 | A | 5/2002 |
| JP | 2003247003 | A | 9/2003 |
| JP | 2004-156063 | A | 6/2004 |
| JP | 2004-232004 | A | 8/2004 |
| JP | 2005-330573 | A | 12/2005 |
| JP | 2006-257539 | A | 9/2006 |
| JP | 2006-283177 | A | 10/2006 |
| JP | 2007197814 | A | 8/2007 |
| JP | 2008199201 | A | 8/2008 |
| JP | 20100053409 | A | 3/2010 |
| JP | 2011-094187 | A | 5/2011 |
| JP | 2011179031 | A | 9/2011 |
| JP | 2012007205 | A | 1/2012 |
| WO | 2012/063628 | A1 | 5/2012 |

* cited by examiner

ALLOY STEEL POWDER FOR POWDER METALLURGY AND METHOD OF PRODUCING IRON-BASED SINTERED BODY

TECHNICAL FIELD

This disclosure relates to an alloy steel powder for powder metallurgy preferably used in powder metallurgical techniques, and particularly, it aims at improving strength and toughness of a sintered material using such alloy steel powder.

Further, this disclosure relates to a method of producing an iron-based sintered body having excellent strength and toughness produced using the above alloy steel powder for powder metallurgy.

BACKGROUND

Powder metallurgical techniques enable producing parts with complicated shapes in shapes extremely close to product shapes (so-called near net shapes) with high dimensional accuracy, and therefore machining costs can be significantly reduced. For this reason, powder metallurgical products are used as various mechanical structures and parts thereof in many fields.

Further, in recent years, to achieve miniaturization and reduced weight of parts, an increase in the strength of powder metallurgical products is strongly requested. In particular, there is a strong request for strengthening iron-based powder products (iron-based sintered bodies).

Generally, an iron-based powder green compact for powder metallurgy which is a former stage of an iron-based sintered body is produced by adding to an iron-based powder, an alloying powder such as copper powder and graphite powder, and a lubricant such as stearic acid and zinc stearate to obtain an iron-based mixed powder, injecting said powder into a die and performing pressing. Based on the components, iron-based powders are categorized into iron powder (e.g. pure iron powder and the like), alloy steel powder, and the like. Further, when categorized by production method, iron-based powders are categorized into atomized iron powder, reduced iron powder, and the like. Within these categories, the term "iron powder" is used with a broad meaning encompassing alloy steel powder.

The density of an iron-based powder green compact for powder metallurgy which is obtained in a general powder metallurgy process is normally around 6.8 $Mg/m^3$ to 7.3 $Mg/m^3$. The obtained iron-based powder green compact is then sintered to form an iron-based sintered body which in turn is further subjected to optional sizing, cutting work or the like to form a powder metallurgical product. Further, when an even higher strength is required, carburizing heat treatment or bright heat treatment may be performed after sintering.

Conventionally known powders with an alloying element added thereto at the stage of precursor powder include (1) mixed powder obtained by adding each alloying element powder to pure iron powder, (2) pre-alloyed steel powder obtained by completely alloying each element, (3) diffusionally adhered alloy steel powder obtained by partially diffusing each alloying element powder on the surface of pure iron powder or pre-alloyed steel powder, and the like.

The mixed powder (1) obtained by adding each alloying element powder to pure iron powder is advantageous in that high compressibility equivalent to that of pure iron powder can be obtained. However, the large segregation of each alloying element powder would cause a large variation in characteristics. Further, since the alloying elements do not sufficiently diffuse in Fe, the microstructure would remain non-uniform and the matrix would not be strengthened efficiently.

Therefore, the mixed powder obtained by adding each alloying element powder to pure iron powder could not cope with the recent requests for stabilizing characteristics and increasing strength, and the usage amount thereof is decreasing.

Further, the pre-alloyed steel powder (2) obtained by completely alloying each element is produced by atomizing molten steel, and although the matrix is strengthened by a uniform microstructure, a decrease in compressibility is caused by the action of solid solution hardening.

Further, the diffusionally adhered alloy steel powder (3) is produced by adding metal powders of each element to pure iron powder or pre-alloyed steel powder, heating the resultant powder in a non-oxidizing or reducing atmosphere, and partially diffusion bonding each metal powder on the surfaces of the pure iron powder or the pre-alloyed steel powder, and advantages of the iron-based mixed powder (1) and the pre-alloyed steel powder (2) can be combined.

Therefore, high compressibility equivalent to that of pure iron powder can be obtained while preventing segregation of alloying elements. Further, since a multi-phase where partially concentrated alloy phase is diffused is formed, the matrix may be strengthened. For these reasons, development is carried out for diffusionally adhered alloy steel powder for high strength.

As described above, high alloying is one method to enhance strength and toughness of a powder metallurgical product. However, with high alloying, the alloy steel powder which becomes the material hardens to decrease compressibility and increases the burden regarding equipment in pressing. Further, the decrease in compressibility of the alloy steel powder cancels the increase in strength through a decrease in density of the sintered body. Therefore, in order to increase the strength and toughness of powder metallurgical products, a technique is required for increasing the strength of the sintered body while minimizing the decrease in compressibility.

As a technique for increasing the strength of the sintered body while maintaining compressibility such as mentioned above, a technique of adding to the iron-based powder, alloying elements such as Ni, Cu, Mo and the like which improve hardenability, is commonly used. As an element that is effective for this purpose, for example, PTL1 (JPS6366362B) discloses a technique of adding Mo as a pre-alloyed element to the iron powder in a range that would not deteriorate compressibility (Mo: 0.1 mass % to 1.0 mass %), and diffusionally adhering, to the particle surfaces of the resultant iron powder, powders of Cu and Ni to achieve both compressibility at the time of green compacting and strength of members after sintering.

Further, PTL2 (JPS61130401A) proposes an alloy steel powder for powder metallurgy for a high strength sintered body obtained by diffusionally adhering, to the steel powder surface, two or more kinds of alloying elements, in particular Mo and Ni, or Cu in addition to said elements.

With this technique, it is further proposed that, for each diffusionally adhered element, the diffusionally adhered density with respect to fine powders of particle sizes of 44 μm or less is controlled within a range of 0.9 to 1.9 times the diffusionally adhered density with respect to the total amount of the steel powder, and it is disclosed that with a limitation to such relatively broad range, impact toughness of the sintered body is obtained.

On the other hand, Mo based alloy steel powder containing Mo as a main alloying element and not containing Ni or Cu has been proposed. For example, in PTL3 (JPH0689365B), an alloy steel powder containing Mo which is a ferrite-stabilizing element as a pre-alloy in a range of 1.5 mass % to 20 mass % is proposed to accelerate sintering by forming an α single phase of Fe having a rapid self diffusion rate. It is disclosed that, with this alloy steel powder, a sintered body with high density is obtained by applying particle size distribution and the like in the process referred to as pressure sintering, and a uniform and stable microstructure is obtained by not employing a diffusionally adhered alloying element.

Similarly, PTL4 (JP2002146403A) discloses a technique regarding an alloy steel powder for powder metallurgy containing Mo as a main alloying element. This technique proposes an alloy steel powder obtained by diffusionally adhering 0.2 mass % to 10.0 mass % of Mo on the surface of the iron-based powder containing, as a pre-alloy, 1.0 mass % or less of Mn, or less than 0.2 mass % of Mo. It is disclosed that, atomized iron powder or reduced iron powder may be used as the iron-based powder, and that the mean particle size is preferably 30 μm to 120 μm. Further, it is disclosed that the alloy steel powder not only has excellent compressibility but also enables obtaining sintered parts having high density and high strength.

CITATION LIST

Patent Literature

PTL 1: JPS6366362B
PTL 2: JPS61130401A
PTL 3: JPH0689365B
PTL 4: JP2002146403A

SUMMARY

Technical Problem

However, with the techniques disclosed in PTL1 and PTL2, since the diffusion at the time of sintering of Ni is slow, sintering for a long period is required for sufficiently diffusing Ni in iron powder or steel powder.

Further, with the technique disclosed in PTL3, since Mo is added in a relatively large amount of 1.8 mass % or more and the compressibility is low, high forming density cannot be obtained. Therefore, when a normal sintering process (single sintering with no pressurization) is applied, only sintered parts having low sintered density can be obtained, and sufficient strength and toughness cannot be obtained.

Further, the technique disclosed in PTL4 is applied to a powder metallurgy process comprising re-compression and re-sintering of the sintered body. In other words, with a normal sintering method, the aforementioned effect could not sufficiently be achieved.

As described above, from our research, it was revealed that it is difficult to achieve both high strength and high toughness with a sintered body using any alloy steel powder disclosed in the above PTLs 1 to 4.

It could therefore be helpful to provide an alloy steel powder for powder metallurgy that enables achieving both high strength and high toughness of the sintered body using the alloy steel powder, together with a method of producing an iron-based sintered body using the alloy steel powder.

Solution to Problem

To achieve the above object, we made intensive studies regarding the alloy components of the iron-based powder and the adding means thereof, and discovered the following. That is, we discovered that, with an alloy steel powder where Mo is diffusionally adhered to the surface of iron-based powder, if reduced iron powder is used as the iron-based powder and a predetermined amount of Cu powder and graphite powder is added, and when the alloy steel powder is formed and sintered, the sinterability of the reduced iron powder is improved and the pores of the sintered body are refined, and at the same time, due to the acceleration of sintering by the addition of copper powder, and solid solution strengthening and improving effect of hardenability by the addition of copper powder and graphite powder, both strength and toughness of the sintered body are improved. This disclosure has been made based on these discoveries.

We thus provide:

1. An alloy steel powder for powder metallurgy comprising:

an iron-based powder containing a reduced iron powder;

Mo-containing alloy powder adhered to a surface of the iron-based powder;

Cu powder; and graphite powder, wherein the Mo content with respect to a total amount of the alloy steel powder is 0.2 mass % to 1.5 mass %, the Cu powder content with respect to a total amount of the alloy steel powder is 0.5 mass % to 4.0 mass %, and the graphite powder content with respect to a total amount of the alloy steel powder is 0.1 mass % to 1.0 mass %.

2. The alloy steel powder for powder metallurgy according to aspect 1, wherein oxygen content of the iron-based powder is 0.2 mass % or less.

3. A method of producing an iron-based sintered body comprising:

mixing an iron-based powder containing a reduced iron powder with Mo material powder;

performing heat treatment to diffusionally adhere Mo to a surface of the iron-based powder;

adding and mixing Cu powder and graphite powder to obtain an alloy steel powder for powder metallurgy; and then sequentially performing pressing and sintering to obtain an iron-based sintered body, wherein the Mo content with respect to a total amount of the alloy steel powder is 0.2 mass % to 1.5 mass %, the Cu powder content with respect to a total amount of the alloy steel powder is 0.5 mass % to 4.0 mass %, and the graphite powder content with respect to a total amount of the alloy steel powder is 0.1 mass % to 1.0 mass %.

Advantageous Effect

With the alloy steel powder for powder metallurgy described herein, since Ni is not required and compressibility is high, a sintered material (iron-based sintered body) which is low in cost and has both high strength and high toughness can be obtained, even with a normal sintering method.

DETAILED DESCRIPTION

Our methods and components will be described in detail below. The alloy steel powder for powder metallurgy described herein is an alloy steel powder that is obtained by diffusionally adhering Mo-containing powder to the surface of iron-based powder, and that contains a mixed powder wherein the above iron-based powder is a reduced iron powder. By mixing the above mixed powder with an appropriate amount of Cu powder and graphite powder, pressing a green compact, and sintering said green compact, pores of the sintered body are effectively refined and sintering is accelerated.

The reason the pores of the sintered body are effectively refined and sintering is accelerated is thought to be as follows.

Generally, many pores exist in a sintered body, and therefore stress concentrates in pore parts and tends to cause a decrease in strength or toughness of the sintered body. However, with the alloy steel powder for powder metallurgy described herein, as the pores in the sintered body are refined, the degree of stress concentration is mitigated and the sintered neck part is toughened.

In addition, with the alloy steel powder for powder metallurgy described herein, Mo concentrates in the pore surrounding part of the sintered body, and combined with the acceleration of sintering caused by Cu, the pore surrounding part is further strengthened. Further, at the same time, since Mo is low in the matrix part, carbide is less likely generated compared to the sintered neck part. Therefore, a microstructure with high toughness throughout the whole microstructure is obtained.

In other words, it is believed that by the control of pore distribution and Mo distribution, and the sintering accelerating effect obtained by Cu, both high strength and high toughness of the sintered body were made achievable.

The reasons for the limitations of the disclosure are described below. The indication of "%" shall stand for mass %, and unless otherwise specified, it shall stand for a ratio (mass %) with respect to the total amount of the alloy steel powder for powder metallurgy described herein (after diffusionally adhering Mo-containing powder).

In the disclosure, reduced iron powder is mainly used as the iron-based powder. As reduced iron powder, it is preferable to use reduced iron powder obtained by reducing mill scale generated at the time of production of steel materials or iron ore. Reduced iron powder has, compared to atomized iron powder, better formability and coarse pores are hardly produced in formation. Further, because of the good sinterability, there are few coarse pores, and since the pores are refined, the strength and toughness of the sintered body are improved. Therefore, reduced iron powder is preferable. The apparent density of the reduced iron powder may be around 1.7 $Mg/m^3$ to 3.0 $Mg/m^3$. More preferably, it is 2.2 $Mg/m^3$ to 2.8 $Mg/m^3$.

Further, atomized iron powder and the like may be added to the reduced iron powder in a range that would not deteriorate the strength or the toughness of the sintered body. Specifically, if the reduced iron powder accounts for 80% or more of the iron-based powder, it would suffice. More preferably, the reduced iron powder is 90% or more of the iron-based powder.

Reduced iron powders with a maximum particle size of less than 180 μm which is commonly used for powder metallurgy can be used in the disclosure. In other words, powders that passed through a sieve with an aperture diameter of 180 μm defined by JIS Z 8801 may be used.

Further, the oxygen content of the reduced iron powder used in the disclosure is 0.3% or less, preferably 0.25% or less, and more preferably 0.2% or less. This is because lower oxygen content of the reduced iron powder results in better compressibility, accelerates sintering and enables obtaining high strength and high toughness. Further, although the lower limit value of the oxygen content of the reduced iron powder is not particularly limited, it is preferably around 0.1%.

Meanwhile, as the Mo material powder, the desired Mo material powder itself may be used, or an Mo compound that can be reduced to Mo material powder can be used. The mean particle size of the Mo material powder is 50 μm or less, and preferably 20 μm or less. The mean particle size refers to the median size (so-called d50).

As the Mo-containing powder, Mo alloy powders including pure metal powder of Mo, oxidized Mo powder, Fe—Mo (ferromolybdenum) powder and the like are advantageously applied. Further, as an Mo compound, Mo carbide, Mo sulfide, Mo nitride and the like are preferable.

In the disclosure, the Mo-containing powder is preferably adhered uniformly to the surface of the iron-based powder. If not adhered uniformly, Mo-containing powder tends to come off from the surface of the iron-based powder in situations such as when grinding the alloy steel powder for powder metallurgy after adhering treatment, or during transportation thereof, and therefore Mo-containing powder in a free state increases particularly easily. When pressing an alloy steel powder in such state and sintering the resultant green compact, the dispersion state of carbide tends to segregate.

Therefore, to enhance the strength and toughness of the sintered body, it is preferable to uniformly adhere the Mo-containing powder to the surface of the iron-based powder to reduce the Mo-containing powder in a free state resulting from coming off or the like.

Mo content to be diffusionally adhered is 0.2% to 1.5%. If said content falls under 0.2%, both the hardenability improving effect and the strength improving effect are reduced. On the other hand, if said content exceeds 1.5%, the hardenability improving effect reaches a plateau, and causes an increase in the non-uniformity of the microstructure of the sintered body, and high strength and toughness cannot be obtained. Therefore, the Mo content to be diffusionally adhered is 0.2% to 1.5%. It is preferably in the range of 0.3% to 1.0%.

Further, 0.5% to 4.0% of Cu powder and 0.1% to 1.0% of graphite powder are added and mixed to the alloy steel powder for powder metallurgy described herein.

Cu is a useful element that exhibits solid solution strengthening and improving effect of hardenability of the iron-based powder to enhance the strength of sintered parts. Further, Cu powder melts into a liquid phase at the time of sintering, and has an effect of fixing particles of iron-based powder to one another.

However, if the amount added is less than 0.5%, the addition effect is limited. On the other hand, if it exceeds 4.0%, not only does the strength improving effect of the sintered parts reach a plateau but also leads to a decrease in cuttability. Therefore, Cu powder is limited to a range of 0.5% to 4.0%. Preferably, the range is 1.0% to 3.0%. The mean particle size of Cu powder is preferably around 50 μm or less.

C which is a main component of graphite powder is a useful element that dissolves in iron at the time of sintering, and exhibits solid solution strengthening and improving effect of hardenability to enhance the strength of sintered parts. In a case where carburizing heat treatment or the like is performed after sintering and the sintered body is carburized from the outside, the amount of graphite powder added may be small. However, if it is less than 0.1%, the above mentioned effect cannot be obtained. Graphite powder will also be added when carburizing heat treatment is not performed after sintering. However, if the amount added exceeds 1.0%, the sintered body becomes hypereutectoid, and cementite is precipitated and causes a decrease in strength. Therefore, graphite powder is limited to a range of 0.1% to 1.0%. The mean particle size of graphite powder is preferably around 50 μm or less.

The balance of alloy steel powders is iron and impurities. Examples of impurities contained in the alloy steel powder include C, O, N, S, and the like. However, as long as these components are each limited to C: 0.02% or less, O: 0.3% or less, N: 0.004% or less, and S: 0.03% or less, there is no particular problem. In particular, O is preferably 0.25% or less. This is because if the amount of impurities exceeds the above ranges, the compressibility of the alloy steel powder decreases, and it becomes difficult to perform compression molding to form a preformed body having a sufficient density.

Next, the method of producing an alloy steel powder for powder metallurgy described herein will be explained.

First, reduced iron powder as the iron-base powder and Mo material powder which is the material for Mo-containing powder are prepared.

The iron-based powder is the so-called reduced iron powder. As mentioned above, Mo alloy powders including pure metal powder of Mo, oxidized Mo powder, or Fe—Mo (ferromolybdenum) powder and the like are advantageously applied as the Mo material powder. Further, as an Mo compound, Mo carbide, Mo sulfide, Mo nitride and the like are preferable.

Then, the above iron-based powder and Mo material powder are mixed in the above mentioned ratio (Mo content being 0.2% to 1.5% with respect to alloy steel powder for powder metallurgy). The mixing method is not particularly limited, and a Henschel mixer, a cone mixer or the like may be used in performing the method.

Further, by maintaining the mixture at a high temperature, diffusing and bonding Mo to steel in the contact surface of the iron-based powder and the Mo material powder, and then adding Cu powder and graphite powder, an alloy steel powder for powder metallurgy described herein is obtained. As the atmosphere for diffusion-bonding heat treatment, reductive atmosphere or hydrogen containing atmosphere is preferable, and hydrogen containing atmosphere is particularly suitable. The heat treatment may be performed under vacuum. Further, a preferred temperature for diffusion-bonding heat treatment is in a range of 800° C. to 1000° C. Regarding the method of adding Cu powder and graphite powder, conventional methods may be followed.

When heat treatment i.e. diffusion-bonding treatment is performed as mentioned above, the iron-based powder and the Mo-containing powder are normally in the state where they are sintered and agglomerated. Therefore, they are ground and classified into desired particle sizes. Further, annealing may optionally be performed. The particle size of the alloy steel powder for powder metallurgy is preferably 180 μm or less.

In this disclosure, additives for improving characteristics may be added in accordance with the purpose. For example, Ni powder may be added as necessary for the purpose of improving the strength of the sintered body, and powders for improving machinability such as MnS may be added as necessary for the purpose of improving cuttability of the sintered body.

Further, preferable pressing conditions and sintering conditions for producing a sintered body using the alloy steel powder for powder metallurgy described herein will be explained.

When performing pressing using the alloy steel powder for powder metallurgy described herein, a lubricant powder may also be mixed in. Further, pressing may be performed by applying or adhering a lubricant to a die. In either case, as the lubricant, metal soap such as zinc stearate and lithium stearate, amide-based wax such as ethylenebisstearamide, and other well known lubricants may all be used suitably. When mixing the lubricant, the amount thereof is preferably around 0.1 parts by mass to 1.2 parts by mass with respect to 100 parts by mass of the alloy steel powder for powder metallurgy.

Pressing of the alloy steel powder for powder metallurgy described herein is preferably performed with a pressure of 400 MPa to 1000 MPa. This is because if the pressure is less than 400 MPa, the density of the obtained green compact lowers and leads to a decrease in characteristics of the sintered body, whereas if it exceeds 1000 MPa, life of the die shortens and becomes economically disadvantageous. The pressing temperature is preferably in the range of room temperature (around 20° C.) to around 160° C.

Further, the alloy steel powder for powder metallurgy described herein is sintered preferably in a temperature range of 1100° C. to 1300° C. This is because if the sintering temperature is lower than 1100° C., progressing of sintering stops and leads to a decrease in characteristics of the sintered body, whereas if it exceeds 1300° C., life of the sintering furnace shortens and becomes economically disadvantageous. The sintering time is preferably in the range of 10 minutes to 180 minutes.

The obtained sintered body can optionally be subjected to strengthening treatment such as carburizing-quenching, bright quenching, induction hardening, and carburizing nitriding treatment. However, even if strengthening treatment is not performed, the sintered body obtained using the alloy steel powder for powder metallurgy described herein has improved strength and toughness compared to conventional sintered bodies (which are not subjected to strengthening treatment). Each strengthening treatment may be performed in accordance with conventional methods.

EXAMPLES

Although the disclosure will be described below in further detail with reference to examples, the disclosure is not intended to be limited in any way to the following examples.

As iron-based powders, reduced powder with an apparent density of 2.60 g/cm$^3$ or an atomized iron powder with an apparent density of 3.00 g/cm$^3$ was used. Oxidized Mo powder (mean particle size: 10 μm) was added to these iron-based powders at a predetermined ratio, and the resultant powders were mixed for 15 minutes in a V-shaped mixer, then subjected to heat treatment in a hydrogen atmosphere with a drew point of 30° C. (holding temperature: 900° C., holding time: 1 h), and then a predetermined amount of Mo shown in table 1 was diffusionally adhered to surfaces of the iron-based powders to produce alloy steel powders for powder metallurgy.

Then, copper powder (mean particle size: 30 μm) and graphite powder (mean particle size: 5 μm) in the amounts shown in table 1 were added to the alloy steel powders for powder metallurgy, 0.6 parts by mass of ethylenebisstearamide was added with respect to 100 parts by mass of the mixed powders of the alloy steel powders obtained, and then the resultant powders were mixed in a V-shaped mixer for 15 minutes. Then, the resultant powders were pressed into a density of 7.0 g/cm$^3$ and tablet shaped green compacts with length of 55 mm, width of 10 mm, thickness of 10 mm were produced.

The tablet shaped green compacts were sintered to obtain sintered bodies. Sintering was performed in propane converted gas atmosphere at a sintering temperature of 1130° C., for a sintering time of 20 minutes.

To subject the obtained sintered bodies to a tensile test defined by JIS Z 2241, said sintered bodies were processed into round bar tensile test specimens with parallel portion diameters of 5 mm. For Charpy impact test defined by JIS Z 2242, sintered bodies with shapes as sintered which were subjected to gas carburizing of carbon potential of 0.8 mass % (holding temperature: 870° C., holding time: 60 minutes), then quenching (60° C., oil quenching) and tempering (holding temperature: 180° C., holding time: 60 minutes) were used.

The sintered bodies were subjected to tensile tests defined by JIS Z 2241, and Charpy impact tests defined by JIS Z 2242 to measure the tensile strength (MPa) and the impact value (J/cm$^2$). The measurement results of each sintered body are shown in Table 1.

TABLE 1

| Material | Oxygen Content mass % | Mo mass % | Cu mass % | Graphite mass % | Tensile Strength MPa | Impact Value J/cm$^2$ | Remarks |
|---|---|---|---|---|---|---|---|
| Reduced Iron Powder | 0.21 | 1.2 | 0.5 | 0.5 | 1100 | 14.0 | Example 1 |
| Reduced Iron Powder | 0.21 | 1.0 | 1.0 | 0.3 | 1124 | 14.1 | Example 2 |
| Reduced Iron Powder | 0.18 | 0.8 | 2.0 | 0.3 | 1150 | 15.2 | Example 3 |
| Reduced Iron Powder | 0.19 | 0.6 | 3.0 | 0.5 | 1180 | 15.5 | Example 4 |
| Reduced Iron Powder | 0.19 | 0.4 | 4.0 | 0.7 | 1175 | 14.9 | Example 5 |
| Reduced Iron Powder | 0.19 | 0.2 | 2.0 | 0.5 | 1068 | 15.1 | Example 6 |
| Reduced Iron Powder | 0.19 | 1.4 | 1.5 | 0.5 | 1160 | 14.9 | Example 7 |
| Reduced Iron Powder | 0.18 | 0.6 | 3.0 | 1.0 | 1200 | 14.2 | Example 8 |
| Reduced Iron Powder | 0.18 | 1.0 | 2.0 | 0.1 | 1006 | 14.0 | Example 9 |
| Reduced Iron Powder | 0.19 | 1.2 | 0.0 | 0.5 | 970 | 10.3 | Comparative Example 1 |
| Reduced Iron Powder | 0.19 | 1.4 | 2.5 | 0.0 | 955 | 14.6 | Comparative Example 2 |
| Reduced Iron Powder | 0.22 | 0.6 | 1.5 | 1.1 | 930 | 11.7 | Comparative Example 3 |
| Reduced Iron Powder | 0.22 | 1.6 | 1.0 | 0.3 | 1040 | 13.0 | Comparative Example 4 |
| Atomized Iron Powder | 0.10 | 0.8 | 2.0 | 0.5 | 1118 | 9.5 | Comparative Example 5 |
| Atomized Iron Powder | 0.10 | 0.6 | 1.0 | 0.5 | 1047 | 8.9 | Comparative Example 6 |
| 4Ni Material | 0.08 | [4Ni—1.5Cu—0.5Mo] | — | 0.3 | 998 | 13.3 | Conventional Example |

As shown in Table 1, when comparing the tensile strength and impact value of our examples with comparative examples, our examples all showed tensile strength of 1000 MPa or more and impact value of 14.0 J/cm$^2$ or more, and both high strength and high toughness were achieved, whereas the comparative examples were poor in at least one of strength and toughness compared to our examples.

Table 1 also shows the results of a 4Ni material (4Ni-1.5Cu-0.5Mo) as the conventional material. It can be seen that in our examples, characteristics equivalent to or better than conventional 4Ni material can be obtained without using Ni.

The invention claimed is:

1. An alloy steel powder for powder metallurgy comprising:

an iron-based powder consisting of a reduced iron powder;

Mo-containing alloy powder adhered to a surface of the iron-based powder;

Cu powder; and graphite powder, wherein:

the Mo content with respect to a total amount of the alloy steel powder is 0.2 mass % to 1.5 mass %, the Cu powder content with respect to a total amount of the alloy steel powder is 0.5 mass % to 4.0 mass %, the graphite powder content with respect to a total amount of the alloy steel powder is 0.1 mass % to 1.0 mass %, the apparent density of the reduced iron powder is between 1.7 Mg/m$^3$ to 3.0 Mg/m$^3$, the reduced iron powder is obtained by reducing mill scale generated at the time of production of steel materials or iron ore, and the alloy steel powder is free from Ni powder.

2. The alloy steel powder for powder metallurgy according to claim 1, wherein oxygen content of the iron-based powder is 0.2 mass % or less.

3. A method of producing an iron-based sintered body comprising:

mixing an iron-based powder consisting of a reduced iron powder with Mo material powder;

performing heat treatment to diffusionally adhere Mo to a surface of the iron-based powder;

adding and mixing Cu powder and graphite powder to obtain an alloy steel powder for powder metallurgy; and then sequentially performing pressing and sintering to obtain an iron-based sintered body, wherein:

the Mo content with respect to a total amount of the alloy steel powder is 0.2 mass % to 1.5 mass %, the Cu powder content with respect to a total amount of the alloy steel powder is 0.5 mass % to 4.0 mass %, the graphite powder content with respect to a total amount of the alloy steel powder is 0.1 mass % to 1.0 mass %, the apparent density of the reduced iron powder is between 1.7 Mg/m$^3$ to 3.0 Mg/m$^3$, the reduced iron powder is obtained by reducing mill scale generated at the time of production of steel materials or iron ore, and the alloy steel powder is free from Ni powder.

* * * * *